US006109820A

United States Patent [19]

Hughes, Sr.

[11] Patent Number: 6,109,820

[45] Date of Patent: Aug. 29, 2000

[54] ANCHOR BASE FOR FLEXIBLE MARKER

[75] Inventor: Robert K. Hughes, Sr., Fort Myers, Fla.

[73] Assignee: Flexstake, Inc., Fort Myers, Fla.

[21] Appl. No.: 09/048,947

[22] Filed: Mar. 26, 1998

Related U.S. Application Data

[60] Provisional application No. 60/041,771, Mar. 31, 1997.

[51] Int. Cl.[7] ..... E01F 9/017

[52] U.S. Cl. ..... 404/10; 116/63 R

[58] Field of Search ..... 404/6, 9, 10, 11, 404/12, 13, 14, 15, 16; 116/63 P, 63 R; 40/606, 608, 612

[56] References Cited

U.S. PATENT DOCUMENTS

| | | | |
|---|---|---|---|
| 1,269,212 | 6/1918 | Poole . | |
| 1,443,204 | 1/1923 | Bernstein . | |
| 1,599,928 | 9/1926 | Sweeney . | |
| 1,668,288 | 5/1928 | Schrank . | |
| 1,676,843 | 7/1928 | Stephens | 404/10 |
| 1,773,487 | 8/1930 | Hines . | |
| 1,773,488 | 8/1930 | Hines . | |
| 1,901,333 | 3/1933 | Parkhurst | 404/10 |
| 1,931,174 | 10/1933 | Withers | 404/10 |
| 3,312,156 | 4/1967 | Pellowski . | |
| 4,090,465 | 5/1978 | Bell, Sr. . | |
| 4,645,168 | 2/1987 | Beard | 248/548 |
| 5,040,478 | 8/1991 | Hughes . | |
| 5,197,819 | 3/1993 | Hughes . | |
| 5,205,236 | 4/1993 | Hughes . | |
| 5,277,146 | 1/1994 | Hughes, Jr. . | |
| 5,788,405 | 8/1998 | Beard | 404/10 |

FOREIGN PATENT DOCUMENTS

| | | | |
|---|---|---|---|
| 530277 | 8/1957 | Belgium | 404/10 |
| 0213114 | 3/1987 | European Pat. Off. | 404/10 |

OTHER PUBLICATIONS

Flexstake FG brochure "The Mow Over Marker that can Walk on Water!".

*Primary Examiner*—James A. Lisehora

*Attorney, Agent, or Firm*—Felsman Bradley Vaden Gunter & Dillon, LLP; James E. Bradley

[57] ABSTRACT

A flexible marker assembly and base for traffic control markers or other purposes. The flexible marker assembly includes a substantially vertical flat marker mounted in a receptacle in a base. A first and second longitudinal arcuate surface is provided on a first and second side of the marker for supporting the flexible marker when the marker is bent, as may occur when the marker is impacted by a vehicle. The flat marker is inserted within a receptacle and is secured to the base by an anchor plate, which is either inserted within the receptacle or positioned below the base to engage the marker. The longitudinal arcuate surfaces have channels formed therein to allow access to fasteners, which connect the marker to an anchor plate.

3 Claims, 2 Drawing Sheets

ANCHOR BASE FOR FLEXIBLE MARKER

CROSS-REFERENCE TO RELATED APPLICATIONS

This application claims the benefits of provisional patent application Ser. No. 60/041,771, filed on Mar. 31, 1997, in the U.S. Patent & Trademark Office.

TECHNICAL FIELD

This invention relates in general to traffic control devices and in particular to a base for flexible traffic control markers.

BACKGROUND OF THE INVENTION

A problem with placing traffic control devices on roadways is that the traffic control devices are frequently struck by vehicles and displaced from their intended location. Examples of commonly used traffic control devices include the use of traffic cones. To prevent inadvertent displacement of traffic control devices, a traffic control device that remains in place even if it is struck by a vehicle is needed.

It is generally known to provide traffic directing devices that employ flexible shafts so that the shaft will bend when struck by a vehicle. Examples of such devices can be found in U.S. Pat. No. 1,267,021, to Watts, U.S. Pat. No. 1,487,635 to Watts, U.S. Pat. No. 1,599,066 to Rushmore, U.S. Pat. No. 2,165,704 to Hood, and U.S. Pat. No. 4,090,465 to Bell, Sr. However, insofar as applicant is aware, none of the previous devices provide a base that supports a wide marker that may be deflected by a passing vehicle. A wide marker is desirable for improved visibility.

SUMMARY OF THE INVENTION

The invention is a flexible marker assembly and base for traffic control markers or other purposes where flexible markers are useful. The flexible marker assembly includes a substantially vertical flat marker mounted in a receptacle in a base. A first and second longitudinal arcuate surface is provided on a first and second side of the marker for supporting the flexible marker when the marker is bent, as may occur when the marker is impacted by a vehicle. The flat marker is inserted within a receptacle and is secured to the base by an anchor plate, which is either inserted within the receptacle or positioned below the base to engage the marker. The longitudinal arcuate surfaces have channels formed therein to allow access to fasteners, which connect the marker to an anchor plate.

It is an object of the present invention to provide an anchor base and flexible marker assembly that can incorporate a wide marker, which can be easily seen by motor vehicle operators.

It is a further object of the present invention that the assembly be constructed in a manner that will permit the device to be struck by a motor vehicle or other object without the device being damaged.

These and other objects and advantage will become apparent in the details of construction and operation as hereinafter described in the Best Mode for Carrying Out the Invention with reference to the drawings.

MODE FOR CARRYING OUT THE INVENTION

Figure 1:
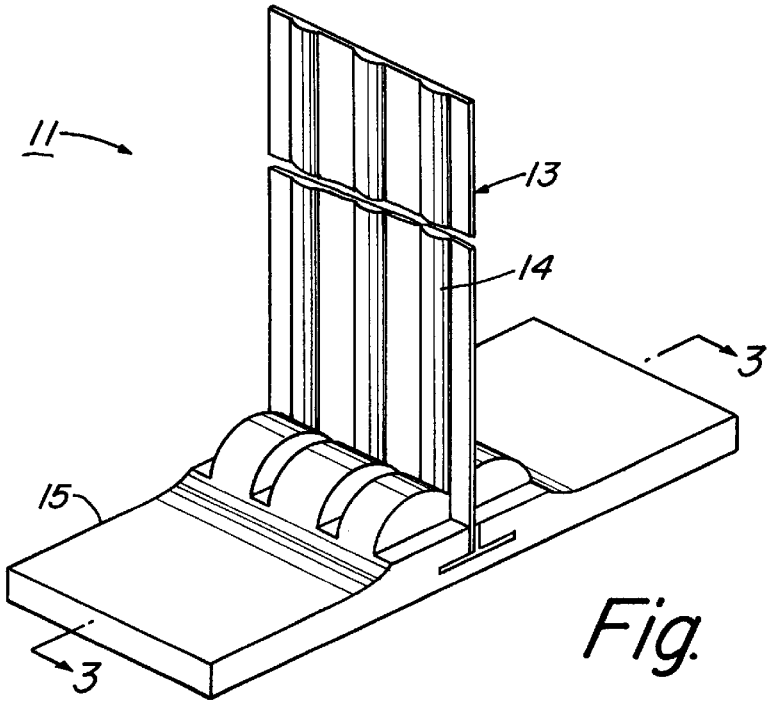
FIG. 1 is an isometric view of a traffic control apparatus having a base constructed in accordance with the invention.

Referring to FIG. 1, a traffic control apparatus 11 for marking roadways is shown. Apparatus 11 has a vertical plastic marker 13 and a generally horizontal anchor base 15 that are substantially the same width. Marker 13 is a rectangular, visibly coated warning device that is sufficiently thick to resist casual bending or flexing along its length so that it remains upright during normal use. However, marker 13 is sufficiently thin and flexible so that it will elastically deform when a significant force is applied, such as by a moving automobile. In the embodiment shown, marker 13 has longitudinal stiffening ribs 14.

Figure 2:
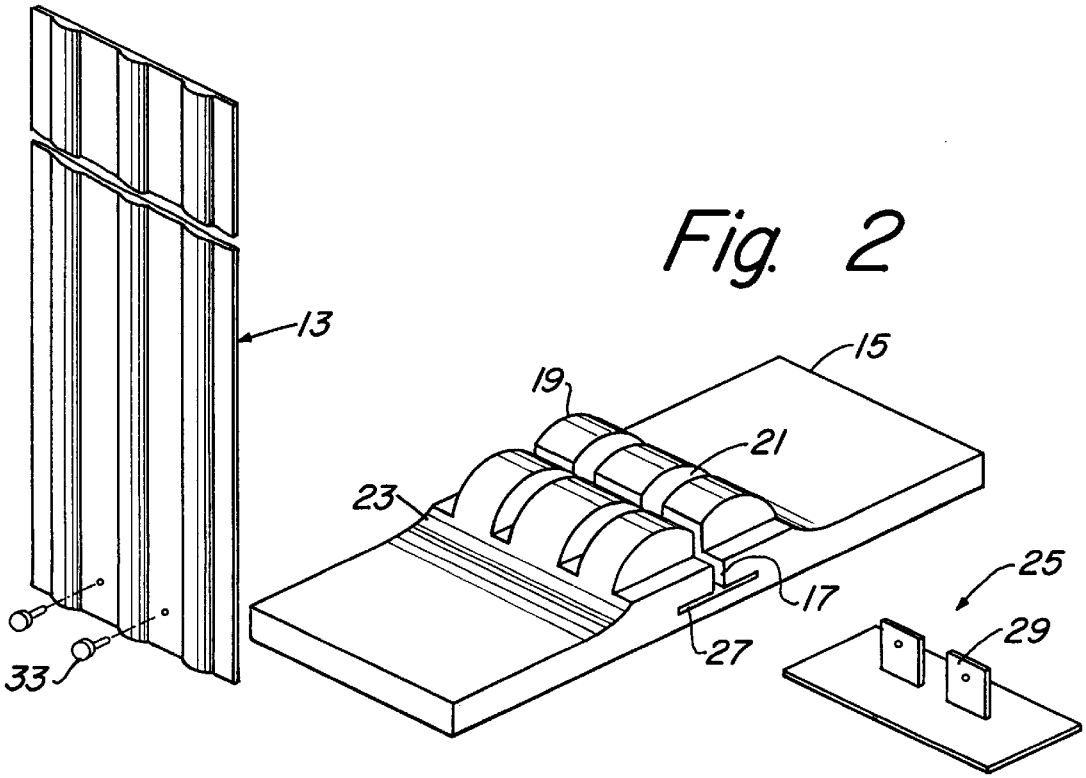
FIG. 2 is an exploded isometric view of the apparatus of FIG. 1.
Figure 3:
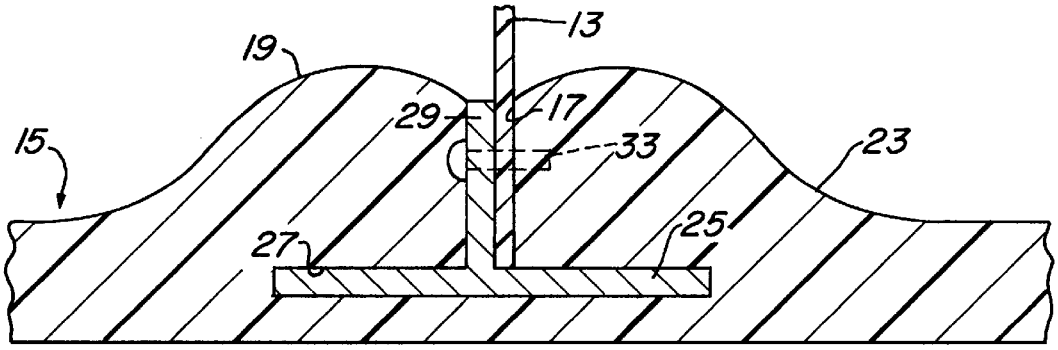
FIG. 3 is a sectional side view of the apparatus of FIG. 1 taken along the line 3—3.

Rectangular anchor base 15 is composed of a high density plastic or rubber material and is significantly heavier than marker 13. Base 15 is adapted to be secured to a roadway with an adhesive for permanent applications or may be portable for temporary uses. As shown in FIGS. 2 and 3, base 15 has a vertical slot 17 which bisects its length and an adjoining horizontal recess 27. Base 15 has a plurality of arcuate portions 19 parallel to and located on each side of slot 17. Arcuate portions 19 extend upward and outward from slot 17. The curve of the arcuate portions extends upward from slot 17 with the apex of each arcuate portion located a selected distance away from slot 17. Each set of arcuate portions 19 has two channels 21. Channels 21 are parallel to each other and perpendicular to slot 17. Base 15 also has a pair of small ramp surfaces 23 that are parallel to slot 17 and lead up to arcuate portions 19.

A metallic anchor plate 25 is inserted into and closely received by recess 27. Anchor plate 25 has a pair of upright flanges 29 which extend upward into slot 17. In alternate embodiments (not shown), anchor plate 25 may be molded into base 15 or installed in a recess in the lower surface of base 15. The lower end of marker 13 is inserted into slot 17 and secured to base 15 and flanges 29 with fasteners 33 (FIGS. 2 and 3). Channels 21 provide access to fasteners 33. Base 15 is secured to a roadway by an adhesive. In a further alternate embodiment, marker 13 is secured within slot 17 by pins 34, which pass through arcuate portions 19 and through orifices 36 of marker 13.

Figure 4:
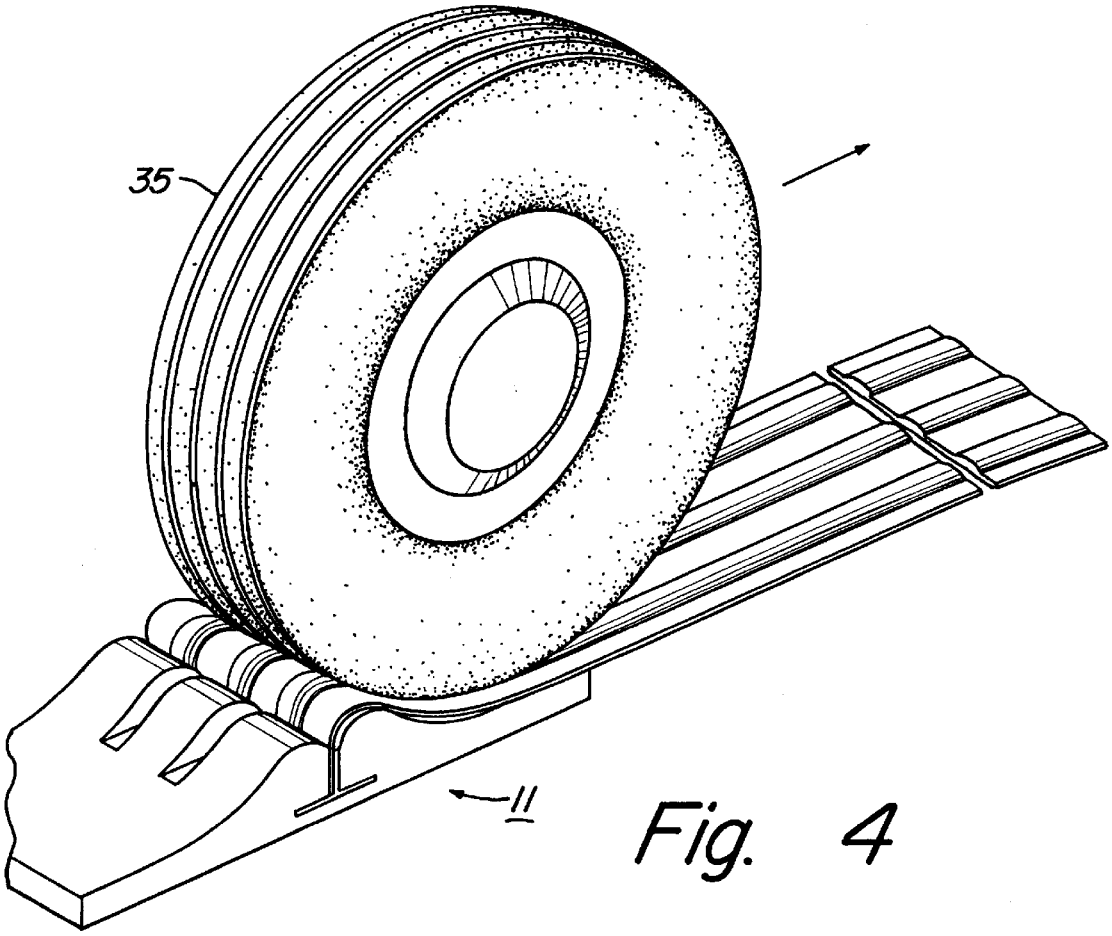
FIG. 4 is an isometric view of the apparatus of FIG. 1 undergoing deformation.

When placed on a roadway, base 15 is designed to support marker 13 in an upright position during normal use and alert automobile drivers of abnormal roadway conditions. Referring to FIG. 4, when traffic control apparatus 11 is struck by a moving vehicle (not shown), it is designed to allow marker 13 to elastically deform before returning to an upright position. When the tire 35 of the vehicle strikes apparatus 11, tire 35 rolls onto base 15 and up ramp surfaces 23 and one set of arcuate portions 19 before striking marker 13. When tire 35 strikes marker 13, marker 13 flexes into a substantially horizontal position, contacts and conforms to the shape of the other set of arcuate portions 19 under the weight of the vehicle. During deformation, arcuate portions 19 allow marker 13 to flex about the radius of the arcuate portions 19 rather than making a sharp, ninety degree bend. The lower end of marker 13 remains securely fastened to base 15. After the vehicle and tire 35 move past apparatus 11, the resiliency of marker 13 allows it to return to an upright position.

The invention has advantages. The arcuate portions on the base allow the marker to flex about a curved radius rather than a sharp bend. This configuration enhances the ability of the marker to return to an upright position when it run over by a vehicle. As a result, the life of the traffic control marker is extended.

While the invention has been shown in only one of its forms, it should be apparent to those skilled in the art that it is not so limited, but is susceptible to various changes without departing from the scope of the invention.

I claim:

1. A flexible marker assembly comprising:

a substantially flat marker having a lower end and being flexible in a first direction and a second direction adjacent to the lower end;

a base having a longitudinal axis and slot for receiving the lower end of the marker and supporting the marker in a vertical position;

a first convex arcuate longitudinal portion on a first side of said slot;

a second convex arcuate longitudinal portion on a second side of said slot;

the first arcuate portion being contoured to be contacted by said marker when said marker is bent to a horizontal position in a first direction to provide a radius of curvature for said marker, the second arcuate portion being contoured to be contacted by said marker when said marker is bent to a horizontal position in a second direction to provide a radius of curvature for said marker;

a recess extending through the base, above a bottom of the base transverse to the longitudinal axis and intersecting the slot;

an anchor plate extending in the recess, the anchor plate on the first and second sides of said slot and having an upward protruding tab that extends upwards in said slot alongside said marker;

a channel formed in one of the longitudinal portions parallel with the longitudinal axis and intersecting the slot; and a fastener extending through said channel into engagement with said marker and said tab.

2. A flexible marker assembly according to claim 1, wherein:

said channel is open to a top exterior of said one of the arcuate longitudinal portions.

3. A flexible marker assembly according to claim 1, wherein:

said anchor plate has a T-shaped cross-section.

* * * * *